US005672148A

United States Patent [19]

Maunier

[11] Patent Number: 5,672,148

[45] Date of Patent: Sep. 30, 1997

[54] HYDRAULIC DEVICE FOR LYMPHATIC DRAINAGE AND MASSAGE OF THE HUMAN BODY

[76] Inventor: Daniel Maunier, 16, La Crémade, Le Tholonet, France, 13100

[21] Appl. No.: 244,315

[22] PCT Filed: Nov. 30, 1992

[86] PCT No.: PCT/FR92/01112

§ 371 Date: Sep. 19, 1994

§ 102(e) Date: Sep. 19, 1994

[87] PCT Pub. No.: WO93/10739

PCT Pub. Date: Jun. 10, 1993

[30] Foreign Application Priority Data

Dec. 6, 1991 [FR] France ..... 91 15473

[51] Int. Cl.[6] ..... A61H 7/00; A61H 19/00

[52] U.S. Cl. ..... 601/148; 601/151; 601/152

[58] Field of Search ..... 601/148–152, 601/61, 17, 55

[56] References Cited

U.S. PATENT DOCUMENTS

| | | | |
|---|---|---|---|
| 3,760,800 | 9/1973 | Staffin et al. | 601/17 |
| 3,865,102 | 2/1975 | Birtwell . | |
| 3,866,604 | 2/1975 | Curless | 601/152 |
| 3,878,839 | 4/1975 | Norton | 601/152 |
| 4,206,751 | 6/1980 | Schneider | 601/152 |
| 4,343,302 | 8/1982 | Dillon | 601/152 |
| 4,419,988 | 12/1983 | Mummert | 601/151 |
| 4,648,392 | 3/1987 | Cartier | 601/151 |
| 4,945,905 | 8/1990 | Dye | 601/152 |
| 5,167,227 | 12/1992 | Meserlian | 601/151 |

*Primary Examiner*—Robert A. Hafer
*Assistant Examiner*—Justine R. Yu
*Attorney, Agent, or Firm*—Dvorak and Orum

[57] ABSTRACT

A hydraulic device for lymphatic drainage and massage of a part of the human body, having an enclosure capable of covering said part of the body, and through which a fluid circulates in the desired massage direction and at varying pressures. The enclosure includes a porous medium that is locally deformable so that the fluid circulates therethrough while being subjected to a given headloss at each point of deformation, thus affecting the flow rate and the pressure of the fluid in order to create a massaging effect.

5 Claims, 3 Drawing Sheets

HYDRAULIC DEVICE FOR LYMPHATIC DRAINAGE AND MASSAGE OF THE HUMAN BODY

BACKGROUND OF THE INVENTION

1. Field of the Invention

The present invention relates to a hydraulic device for lymphatic drainage and massage of the human body.

The technical field of the invention is the field of manufacturing massage appliances that use hydraulic pressure.

One of the main applications of the invention is providing sleeves, e.g. having the shape of a limb, and suitable for putting on the limb, for the purpose of massaging it by transmitting pressure intermittently along its surface.

2. Description of the Prior Art

It has been known for a long time that massage techniques have beneficial effects on the human body for blood circulation, for eliminating fat or cellulite, for relieving pain, for reabsorbing edemas, for improving muscular performance, pleasing shapes: these techniques were originally manual, but over the last few years appliances have been developed for satisfying the increasing demand for this practice and for ensuring that treatment can be made available regularly, and over a long period of time as a replacement for the hand of the masseur, whose training is lengthy and specialized, and who can be available for only one person at a time.

Thus, four types of appliance are available, excluding those that are solely mechanical or mechanical in action, that seek to satisfy the above demand and techniques for providing good lymphatic drainage or massage, by causing variations in pressure on the skin of the human body by means of a fluid:

firstly there are systems with overall action, which are the simplest, and which do indeed apply pressure that is intermittent, but they apply it in uniform manner over the entire surface to be treated: such systems are used very little since they are ineffective in practice, being far removed from the effect of a massage;

systems have thus been developed having a plurality of compartments into which fluid is injected under intermittent pressure, which pressure is applied over the entire surface of the compartment that is in contact with the corresponding part of the body, the compartments being activated successively while pressure is caused to drop in preceding compartments so as to generate a pressure wave in the desired direction, as can be done by the hand of the masseur: in this category of system, there can be found patent applications FR 2 616 064 (Suissa), FR 2 615 397 (Frajdenrasch), FR 2 548 017 (Tissot), and FR 2 511 242 (MEGOAFEK Industrial Measuring), and many others; however the complexity of their implementation requires control to be provided by electrically-controlled valves for opening and closing compartments, and depending on the type of fluid used, either a gas or a liquid, the resulting effectiveness and reliability are often not as could be desired, due to lack of accuracy and due to local negative gradients inevitably being created, thus having a highly negative effect.

Naturally, each has its own particularities and special essential characteristics, suitable for improving effectiveness in one field or another, thereby justifying patentability, even if the same principle is applicable to all of them.

Those systems are complex and they always transmit a pressure wave of the same amplitude to all of the points of the surface to be massaged, and that does not genuinely reproduce the effect of a massage that ought to taper off from one point to another while decreasing linearly without any clearly-marked steps;

in parallel with such complex compartmented systems, there can be also be found systems that do not use hydraulic or pneumatic pressure obtained by fluid circulation, but that use the static pressure of a high density fluid, essentially mercury: a rigid tank or sleeve is filled with this fluid and the limb that is submerged in it is subjected to a perfect pressure gradient which diminishes linearly from one point to another; the alternating variation of the fluid level thus produces a massage effect. In this domain we note patent requests FR 2.619.710 of Aug. 24, 1987 by Mr. P. VENDEVILLE and FR 2.639.222 of Nov. 18, 1988 by Mr. Claude J. CARTIER.

However, these systems are quite heavy to implement and often very expensive; because the pressure on the lower portion is significant, it can cause uncomfortable reactions and have medical contraindications: the buoyancy factor that applies to the immersed limb, being greater than the weight of the body, requires further reinforced support of the body, making sessions even more uncomfortable for the patient.

Finally, flexibility of application is limited by the few possibilities of pressure variation and by the patient's required vertical position:

— to attempt to achieve an effective massage with intermittent pressure on the surface of the body but in a simpler yet still linear manner, a final type of apparatus was developed, of which this invention is one. Taking an apparatus with overall action, i.e. comprising a sole enclosure, we vary the pressure within this apparatus at various points along its surface; in this domain we note patent request FR 2.654.930 of Nov. 29, 1989 and its addition FR 2.659.549 of Mar. 14, 1990 filed by Mr. D. PERROTIN, which relates a "wall intended to exercise said pressure made of a flexible and elastic material, which has a non-identical dilation coefficient that is not constant along its periphery". However this system dictates specific enclosures with rupture points provided at desired locations and it is therefore not adaptable from one person to another requiring a different type of massage and also having different morphology; in addition, it is difficult to ensure control of non-identical deformations and the reliability of massages being repeatable is doubtful.

Within that type of equipment having a single enclosure, there are also to be found equipments constituted by pipework surrounding the part of the body like a spring, for example the equipment described in patent DE 260 31 32 (Zeppelin) that uses gas released intermittently into said pipework and thus transmitting a pressure wave, but that is not controllable because of the expansion of the gas, and that does not give rise to a linear massage effect in the desired direction, as mentioned above.

The problem posed is thus to be able to transmit a large variety of pressure ranges over any portion of the surface of the body with variation in said pressure complying with profiles adapted to each particular case, as a function of the looked-for result, and being controllable and repeatable, without requiring complex implementation and which reproduces as well as possible the effects of manual massage using progressive pressure waves of mean amplitude that decreases in the propagation direction of the wave.

SUMMARY OF THE INVENTION

A solution to the problem posed is a hydraulic device for lymphatic drainage and massage of a portion of the human body, comprising at least one enclosure capable of covering said part of the body, and in which there flows a fluid in the desired massage direction and at a varying pressure p, said enclosure being single and suitable for covering the entire surface of the said part of the body, being locally undeformable solely under the effect of said pressure p; said enclosure being filled with a porous medium of given low permeability that is determined as a function of the section of the fluid circulation volume and in such a manner that the fluid flows therein while being subjected to a given headloss in each zone of said enclosure, related in particular to the flow rate and to the pressure of the fluid at the inlet to said enclosure.

Said fluid may be a fluid of high viscosity, and is determined as a function of the section of its circulation volume inside the enclosure and of its adhesion against the walls along which it circulates; in one embodiment, the outside walls of the assembly are permeable to said fluid.

In a preferred embodiment, the outside wall of the enclosure is voluntarily deformable by any means in order to modify the section of the inside volume through which the fluid circulates at given points.

Another object of the present invention is achieved by a device which comprises pressure sensors inside said enclosure, connected to an external central unit that compares the sensed pressures with reference values that have previously been determined as a function of the desired type of massage, and that enable the flow rate and the pressure at the fluid inlet into the enclosure to be regulated so as to obtain said reference values.

The result is novel hydraulic devices for lymphatic drainage and massage of the human body that satisfy the problem posed and that eliminate the drawbacks to be found in previously existing systems.

The present invention is based on the known hydraulic principle of the headlosses that are produced to a greater or lesser extent in the flow direction of a liquid or gaseous fluid that is viscous and that is flowing through a medium of greater or lesser permeability depending on said viscosity of the fluid.

The device of the invention makes it possible to apply that hydraulic principle to techniques of massaging the human body, by controlling the headlosses so as to obtain pressure that is variable and that tapers off linearly in the desired direction on the part of the body concerned, and the very principle involved makes it possible to achieve a very wide variation in the effects obtained.

Fields of application are thus innumerable, since starting from static pressure at zero flow rate, thus without linear variation, which pressure may be very small or very large, it is possible to vary the flow rate of the fluid, and by adjusting the starting pressure and the ending pressure over an arbitrary distance it is possible to obtain pressure gradients that are gentle or steep. Pressures may be subjected to intensity modulation at variable frequencies, lying in the range fractions of a hertz to several thousands of hertz, thus creating long-period massages or else vibrations.

In addition, by deliberately modifying the outside wall of the enclosure through which the fluid flows, it is possible to increase or decrease the highest pressure zones by increasing or decreasing the fluid flow section, thus making it possible to obtain a pressure profile on demand depending on the type of massage that is desired: this wall modification can be adjusted for each case and may even be modulated while in operation, in combination with possible modification of the inlet pressure and of the fluid flow rate, thus obtaining pressure profiles that are not only linearly tapering on average, but that also follow any curve that may be desired.

In the medical field, an envelope on any part of the body can thus transmit a large quantity of pressure effects, be they very gentle such as stroking, sliding, drainage, etc. . . . or very strong such as for massaging, and they may follow any desired frequency and profile, thus enabling a very wide range of techniques to be applied both superficially and in depth on the part of the body in question, for the purpose of lymphatic drainage, improving blood circulation, etc. . . . .

It is thus possible, firstly to obtain the same effects as in the systems mentioned above using present known techniques but limited to a single type of action as are mercury systems, overall action systems, or systems that have a non-uniform expansion coefficient, and secondly to improve the effects of systems having compartments by obtaining pressure that varies linearly and not in steps, while simultaneously enlarging options to other cases that cannot be solved by present-day systems.

In addition, the entire circuit is controllable, thereby ensuring that its actions are reliable and repeatable, while still requiring implementation that is simple and not onerous.

Other advantages of the present invention could be mentioned, but those given above already suffice to demonstrate the novelty and the advantages of the invention.

The following description and figures relate to a particular embodiment of the invention but have no limiting character: other embodiments are possible within the ambit of the scope and the extent of the present invention, in particular by changing the basic shape of the enclosure which may be fitted to any part of the body whatsoever, such as a portion of a limb, a foot, a hand, an abdomen, an entire limb, etc. . . . , and it is also possible to imagine other applications in fields other than medicine, where it is desired to apply controlled pressure variations over an entire surface, which variations are to be controllable in compliance with a given profile.

DESCRIPTION OF THE PREFERRED EMBODIMENT

Figure 1:
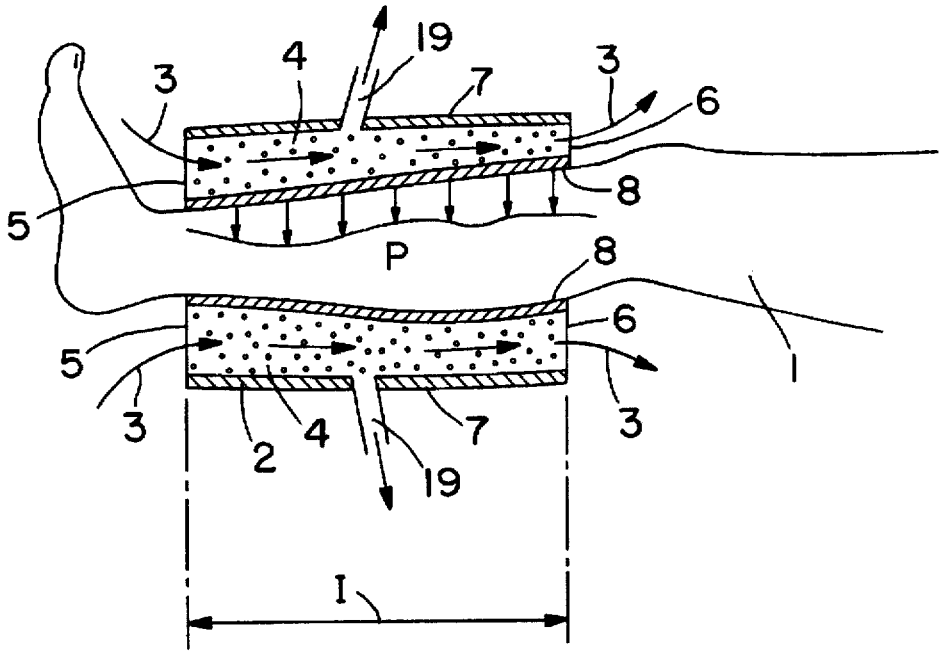
FIG. 1 is a section view through a portion of the device on a leg.

FIG. 1 is a section view through a portion of a device installed on a leg, by way of example, with the entire calf of a person being surrounded by a circular enclosure 2 that wraps around the calf, the enclosure being of length l that may run from the ankle to the bottom of the knee, however it could be shorter or longer in which case it could cover the upper portion of the leg as well.

Figure 3:
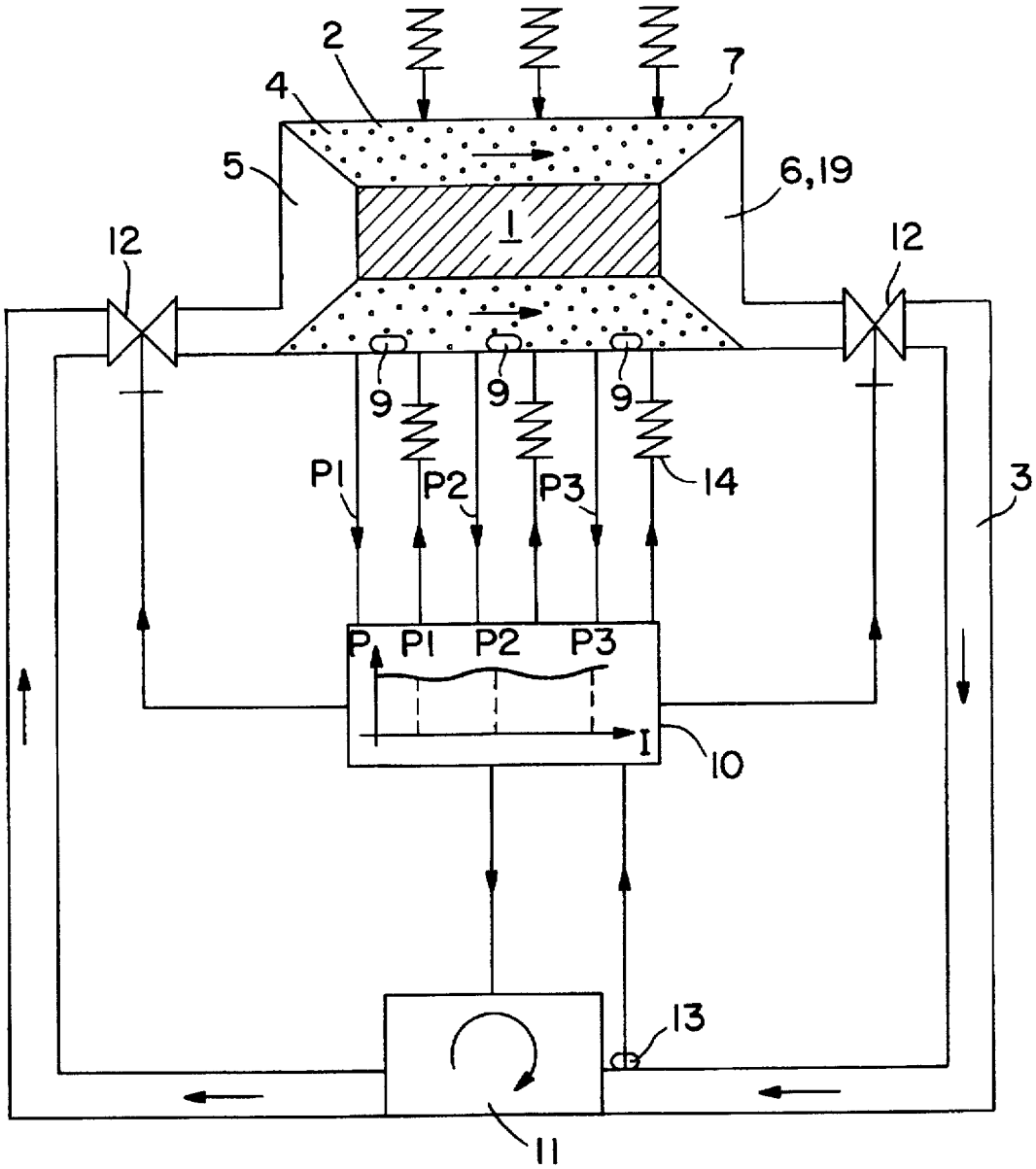
FIG. 3 is a diagram of the entire device.

The hydraulic device of the invention for lymphatic drainage and massaging of said portion 1 of the human body comprises an enclosure 2 capable of covering said portion of the body and in which a fluid 3 flows in the desired massaging direction at a pressure p that varies. To do this, the fluid penetrates via an inlet 5 situated at the base of the device, in this case near the ankle of the patient; said inlet 5 may be of any type, and it provides sealing around said ankle and is connected to any appropriate system for feeding said fluid; the fluid then leaves via the top portion of the device, in this case near the bottom of the knee via an outlet 6 likewise providing sealing at that point, which outlet may either be open to the ambient medium if that is possible with the fluid in question, or else it is connected to any appropriate circuit, enabling the fluid to be circulated, as shown in FIG. 3.

In the present invention, the said enclosure 2 is undeformable locally under the sole effect of said pressure p, such that said pressure is controllable and can act directly on the limb or the part of the body concerned 1; however that does not mean that the enclosure is undeformable overall since the outside wall thereof may be relatively flexible and thus uniformly deformable in controllable manner in the direction transverse to the fluid circulation direction, under the overall effect of the pressure; the fluid 3 circulates through the enclosure in laminar mode being subjected to a given headloss in each zone of said enclosure 2 as a function of the flow rate and/or of the pressure of said fluid at the inlet 5.

The headloss may be caused either because said enclosure 2 is filled with a porous medium 4 of given low permeability that is determined as a function of the circulation volume for the fluid 3, or because said fluid 3 is of viscosity that is high and fixed as a function of the section of its volume flowing through the enclosure 2, and because of its adherence to the walls along which it circulates, or because of the porosity and permeability of the outside wall 7 of the enclosure itself allowing the fluid to escape via distributed porosity or via orifices 19 provided at special points, or over larger zones, in a circular configuration or otherwise, or else by a combination of two or three of the above possibilities for establishing any desired headloss.

Said porous medium 4 may be constituted by solid or hollow beads or by grains of sand, or by fiber cloth, or by foam, or by microtubes, or by laminated layers, or by any kind of particle selected as a function of the looked-for permeability and mechanical characteristics.

The pressure p is transmitted to the part of the body 1 either directly by said limb or part of the body being directly immersed or covered in said enclosure 2 optionally filled with said medium 4, or in another embodiment said enclosure 2 includes an outside wall 7 that is practically rigid and an inside wall 8 that is flexible. The flexible wall then covers said part of the body 1, and transmits thereto the pressure p of the fluid 3 which passes through the surface of the wall that serves solely for transmission purposes and thus isolates the skin of the person from the fluid circulating in said enclosure.

Preferably, the outside wall 7 of the enclosure 2 is premolded to the shape of the part of the body 1. It may be personalized, and relatively flexible, while nevertheless remaining sufficiently rigid to avoid being locally deformed by said pressure, while being sufficiently flexible to accommodate possible excess pressures and to enable finer adjustments to the morphology of the limb. This outside wall 7 is either impermeable to the fluid circulating inside the enclosure, or else it is permeable thereto in controlled manner so as to create an additional headloss effect, assuming that the fluid is compatible with the outside medium, or it may be impermeable over a major fraction of its surface and open at special points 19 optionally connected to an outside circuit.

Figure 2:
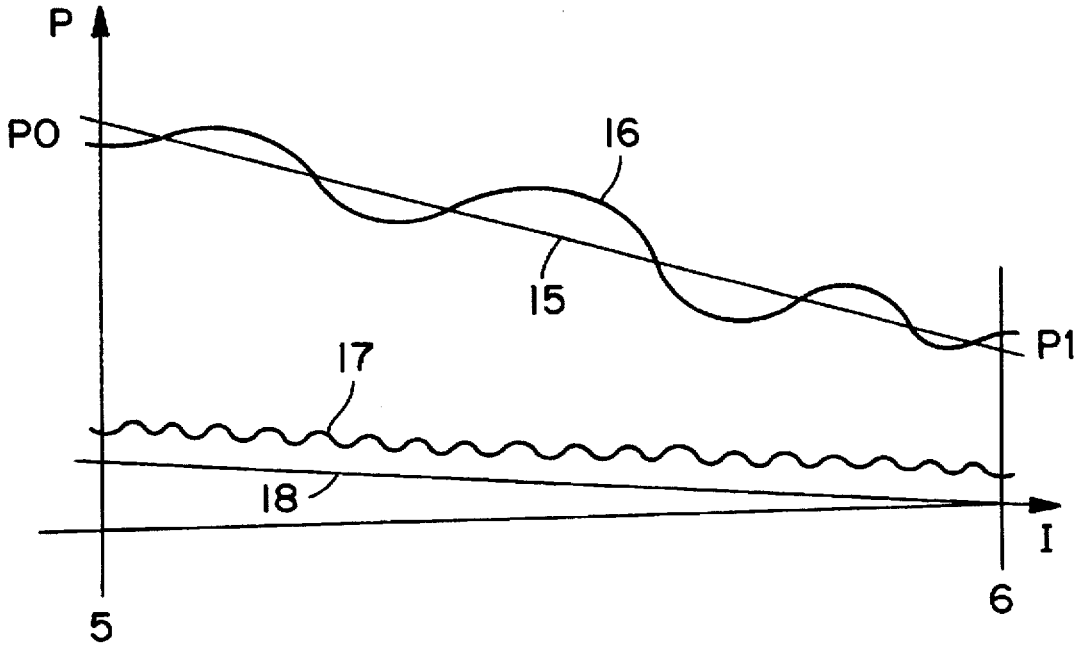
FIG. 2 shows an example of pressure curves.

FIG. 2 shows an example of a pressure curve that can be obtained using the device of FIGS. 1 to 3.

The pressure p that exists at any point of said enclosure 2 is plotted up the ordinate, and the position of said point along the length l of said enclosure is plotted along the abscissa: the origin corresponds to the fluid inlet 5 into said enclosure, and the end of the curve corresponds to the outlet 6 from said enclosure; the curves shown herein correspond to a given inlet pressure p0 having the same section configuration for the circulation volume through said enclosure 2, which enclosure thus has a given laminar flow rate of fluid 3 that is constant throughout said volume.

By varying the inlet pressure p0, the through section for said fluid at various points along the enclosure 2, and also the flow rate of the fluid as a function of the inlet pressure p0, it is possible at any given time t to obtain curves other than those shown in FIG. 2, the curves being of various appearances as a function of requirements, but always linear and continuous in general shape.

In FIG. 2, there is plotted merely the outcome of a pressure p0 at the inlet 5 all the way to the outlet 6 for the overall volume being in a steady state, in order to simplify the discussion.

Curves 15 and 18 are curves obtained for given laminar flow conditions having inlet and outlet pressures p0 and p1 that are likewise constant, the headloss $\delta p=(p1-p0)$ being defined as a function of the permeability of the internal medium 4, of the viscosity of the fluid 3, and of the loss of fluid flow, if any, through the outside wall 7.

Curves having slopes that are deeper or shallower are obtained as a function of the possibilities of varying said permeability as defined above by varying the section of the flow volume or by varying the viscosity of the fluid 3, or by varying the flow rate of a given fluid 3. Thus, curve 15 may be obtained with a flow of water taken from an ordinary tap and passing through polyethylene foam. It is thus possible to obtain an inlet pressure of 1.8 bar, an outlet pressure of 1.2 bar over a length l of the enclosure equal to 40 cm, with curve 18 being obtained by a drop-by-drop flowrate likewise of water through the same polyethylene foam, but this time with an inlet pressure of 0.3 bar and an outlet pressure of 0.15 bar. Depending on circumstances, the fluid circulation flow may even be infinitesimal.

By changing the permeability density of the foam, or by replacing water with some other fluid of different viscosity, or by changing the porosity of the wall 7, it is possible to obtain any curve p0, p1 of any steeper or shallower slope, and also any inlet pressure p0 that is higher or lower, so as to obtain the desired linear variation in pressure.

In addition, by causing the inlet pressure p0 to vary in application of a sinusoidal type of sequence, and by causing it to vary relatively slowly, it is possible to obtain a curve of the type referenced 16, whereas by varying the pressure at a much higher frequency it is possible to obtain a curve 17 with much choppier variations that are more like vibration than like massage. The outlet pressure p1 may also be negative by connecting a suction system to the outlet of the enclosure 6.

By way of comparison, systems of the mercury tank type give rise to a curve (p0, p1) of very steep negative constant slope associated with the density of mercury. It is also possible to obtain a curve of that type and even one that is even more negative using a device of the invention by superposing the three headloss effects: and naturally by increasing viscosity, by reducing the permeability of the medium inside the enclosure of the device, and by allowing the fluid to escape as it circulates through the enclosure.

As shown in FIG. 1, the enclosure 2 may include intermediate outlet orifices 19 for the fluid 3, which orifices may be highly localized and point-like over special zones to be treated by a local pressure variation effect, or they may cover a more extensive zone, e.g. along an entire circumference of a cylindrical enclosure, when the enclosure surrounds a limb. The orifices 19 may be connected to an external suction system and may even give rise to local negative pressures. Thus, it is even possible to implement devices of the invention in which the fluid 3 penetrates into the enclosure 2 under pressure or otherwise via its ends 5 and 6 and leaves the enclosure via one or more intermediate orifices 19 under negative pressure: in addition, when said enclosure 2 is placed on a surface without making a complete turn around a part of the body, the ends 5 and 6 then constitute merely a single fluid inlet or outlet perimeter and the orifice 19 may be central, being placed accurately over a zone to be treated, e.g. an edema and constituting the corresponding outlet or inlet respectively. In such a configuration, the fluid may flow in the reverse direction, penetrating into the enclosure via the orifice 19 and leaving it via the peripheral orifices 5 and 6.

In the configuration of FIG. 1, the fluid may also be caused to circulate by making it penetrate into the enclosure 2 via said orifices 19 distributed along said enclosure, and leaving the enclosure via the end orifices 5 and 6, which then both become outlet orifices. Under such circumstances, the fluid 3 flows from middle zones of the said enclosure towards its ends, being subjected to headlosses therein so as to obtain the desired effect of pressure variation on the part of the body to be treated, as in all of the configurations of the device described above.

In all of these embodiments, the main object is to perform massage by means of the essential characteristics of the invention which is to cause a fluid 3 to circulate through an enclosure 2 in the desired massage direction so as to establish a varying pressure p, by including given headlosses in application of the various options described above in the various zones of said enclosure 2, associated in particular with the flow rate and the pressure of the fluid at any inlet to said enclosure. The enclosure may thus be of various different shapes having one or more inlets and one or more outlets defined as a function of type of massage and part of the body to be treated.

FIG. 3 is a diagram of the entire device in which the enclosure 2 of FIG. 1 is shown again schematically. The portion of the limb of the human body that is to be massaged or drained is represented by a rectangle 1 subjected to the pressure or the suction transmitted by the fluid 3 inside the volume 4 of said enclosure 2.

The outside wall of said enclosure 2 is represented in this case as being externally deformable by any mechanical or hydraulic system 14 for modifying the shape of said wall 7 by reducing at certain points the through section of the inside volume for circulation of the fluid 3 at given points.

The device may also comprise a compressor or some other hydraulic pump 11 causing said fluid 3 to flow through flow rate controlling valves 12 at the inlet and at the outlet of the enclosure 2 so as to obtain the desired flow rates, inlet pressure 5, and/or possible suction at the outlet 6 and/or pressure or suction at the orifice(s) 19. In order to make the entire device automatic so as to obtain safety and repetitively the desired drainage or massaging technique, the flow rate adjusting valves 12, the circulating pump 11, and the various systems for modifying the enclosure 14 are all connected to an external central unit 10. Suitable pressure sensors 9 situated at various points pi within said enclosure 2 enable the central unit to compare the pressures picked up by said sensors with reference values that have previously been determined as a function of the desired type of drainage or massage, thus enabling the parameters of the flow rate adjustment valves 12 and of the circulation pump 11 to be altered so as to adapt towards the appropriate flow rate, which itself can be measured by a sensor 13 situated in the pumping circuit for said fluid 3.

Using the above configuration and a schematic as shown in FIG. 3, other modules may be added, e.g. for controlling the pressure at various other locations, and also for measuring the temperature of the fluid. The entire assembly can be used in any position, horizontal or vertical, and indeed in weightlessness, e.g. by immersing the enclosure 2 in place around the limb in question 1, since given that the assembly is hydraulic it is not influenced in any way by the position of the enclosure.

In a simplified embodiment, the circuit may be opened to the outside medium via the outlet 6 from the massage enclosure 2. For example, under such circumstances, the compressor or pump 11 may be an air compressor taking air from the atmosphere, which air is then exhausted into the atmosphere after it has performed its massage "work". Similarly, if the equipment is used in a tank or pool, then the pump may be a hydraulic pump 11 taking its fluid from the tank or pool in which the person may be installed, with said fluid likewise flowing back into the tank or pool after it has passed through the enclosure 2.

The enclosure may also be a suit of the diving suit type worn directly on the part of the body concerned.

This greatly expands the horizon of possible applications, running from cheap standard systems, that are transportable and optionally pressurized by hand, up to applications that are much more complex, molded, and controlled by a computer, as shown in FIG. 3.

Furthermore, a plurality of different enclosures may be used in combination, either one after another so as to increase the action available in the longitudinal direction over the part of the body to be treated, or else independently so as to treat several parts of the body simultaneously, with each of the enclosures being capable of being connected in application of any one of the embodiments described above, using one or more inlet orifices, one or more outlet orifices, either at the ends of the enclosure and/or distributed along its walls, and all that can be done without going beyond the ambit of the present invention.

Figure 4:
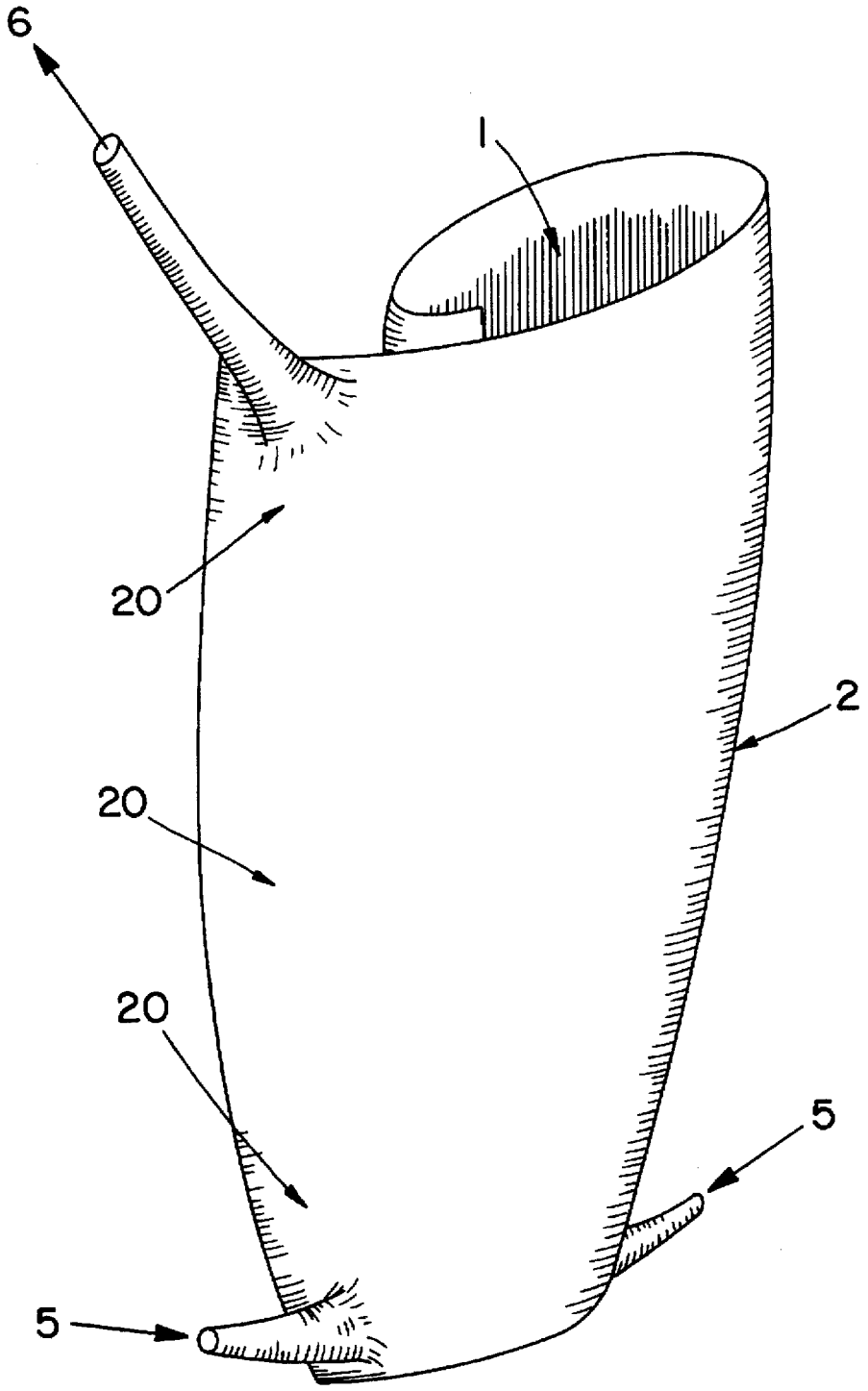
FIG. 4 shows one particular embodiment of an enclosure in accordance with the invention.

Finally, FIG. 4 shows an embodiment of an enclosure 2 of a device in accordance with the invention and made from an envelope suitable for winding around the part of the body to be treated 1, the ends of the envelope overlapping, firstly to ensure continuity of contact with the surface of the body and secondly to provide closure 20 by any appropriate system, e.g. two tapes, each fixed along the edge of a corresponding end and woven differently so that their surfaces hold together when coming into contact in the desired position that can therefore be adjustable, e.g. so-called "Velcro" type fastenings, or by means of an independent external envelope.

Such a roll-up form of device enables its inside volume to be accurately fitted to the volume of any part of the body 1 to be treated, particularly if it is given a conical and/or molded shape generally similar in shape to said part of the body 1, with overlapping and without folds.

The outside wall 7 of the envelope may be made of polyurethane or of latex, and the inside portion 4 may be made of polyester foam, for example.

The fluid is then conveyed to the narrower conical portion placed close to the end of a limb, for example, via one or more inlets 5, and it is likewise exhausted via one or more outlets 6 at the larger conical or top end.

Such an enclosure thus reproduces the characteristics of the invention by enabling a continuous and measurable pressure gradient to be applied without any need for displacing the solid portions constituted by the walls, but merely by means of a special flow of fluid between the inlets 5 and the outlets 6. The circulating fluid is subjected directly to the pressure gradient by continuous headloss along an arbitrary path inside the enclosure 2. The flow of fluid inside the enclosure is obstructed, either because of the high viscosity of the fluid used, or else because of the presence of a porous medium inside the enclosure 2 as described above, or indeed by associating both techniques.

In the context of the present invention, a fluid is said to have high viscosity if its viscosity is greater than that of water.

It is recalled that the means known in the past have made use of a fluid (which is often either gas or merely water) as the means for transmitting a pressure that is generated externally at some given moment to mechanical systems, which in turn attempt to perform massage by means of variation in the pressure that they receive as transmitted by the fluid from the outside, with variations taking place in time and/or with action that is restricted or limited to a section. The pressure gradient therefore never actually exists at a given instant or else it is extremely approximate due to separate compartments. In one case pressure is controlled stepwise by means of the compartment, and in the other case pressure waves are transmitted furtively through small pipes or through flexible walls.

As shown in FIG. 4, in any enclosure of a device of the invention, it is the positions of the inlets and outlets for the fluid that determine the circulation direction and thus the direction in which the gradient is applied to the surface of the part of the body 1 to be treated. Pressure is thus distributed in space which is most advantageous for application to the lymphatic or venous network in the main application of the present invention. The present invention also makes it possible to stimulate immersion of a limb in water or in a liquid of arbitrary density.

I claim:

1. A hydraulic device for lymphatic drainage and massage of a part of the human body, the device comprising:

an enclosure formed from a limb-facing inside wall and an outside wall and having a defined volume, said enclosure having at least one fluid inlet and outlet, each of which is in communication with said volume, said enclosure capable of covering and conforming to only a specific said part of the body wherein a fluid is continuously flowed throughout its entire defined volume in a flow direction desired for achieving said drainage and massage, said fluid having an initial pressure and flow rate when introduced into said inlet of said device, said flow rate through said enclosure being determined as a function of the cross-sectional volume flowing through the enclosure and of a fluid friction against the walls of said enclosure along which it circulates, wherein said outside wall is semi-rigid in order to modify a cross-section of the inside volume of the enclosure through which the fluid flows at a given point;

said device further including a plurality of pressure sensors disposed inside and along a length of said enclosure, said sensors connected to a common external central unit that compares a sensed pressure with a set of reference pressure values that have been previously determined as a function of a desired type of massage, and whereby said central unit can control the flow rate and the pressure of the fluid at the inlet to the enclosure in order to obtain said reference values.

2. The hydraulic device according to claim 1, wherein said enclosure further includes at least one intermediate and one secondary outlet orifice for the fluid, said secondary outlet orifice further contributing to a change in said pressure of said fluid, which said secondary orifices are localized on a special zone to be treated by a localized pressure variation effect caused by said secondary orifice reducing said flow rate at said special zone.

3. The hydraulic device according to claim 2, wherein said enclosure includes at least one intermediate and secondary inlet orifice for the fluid, which secondary inlet orifices are localized on a special zone to be treated by said local pressure variation effect.

4. The hydraulic device of claim 2 wherein a plurality of said secondary outlet orifices are circumferentially disposed around an extended zone of the limb to be massaged, whereby an extended zone of pressure variation around said limb can be created.

5. The hydraulic device of claim 3 wherein a plurality of said secondary inlet orifices are circumferentially disposed around an extended zone to be massaged, whereby an extended zone of pressure variation around a limb of said body can be created.

* * * * *